US011420203B2

(12) United States Patent
Doolan et al.

(10) Patent No.: US 11,420,203 B2
(45) Date of Patent: Aug. 23, 2022

(54) POINT-OF-CARE DIAGNOSTIC ASSAY CARTRIDGE

(71) Applicant: Radisens Diagnotics Limited, County Cork (IE)

(72) Inventors: David Doolan, County Offaly (IE); Donal Cronin, County Cork (IE); Eoin O'Nuallain, County Wicklow (IE)

(73) Assignee: RADISENS DIAGNOSTICS LIMITED

( * ) Notice: Subject to any disclaimer, the term of this patent is extended or adjusted under 35 U.S.C. 154(b) by 163 days.

(21) Appl. No.: 16/343,176

(22) PCT Filed: Oct. 25, 2017

(86) PCT No.: PCT/EP2017/077365
§ 371 (c)(1),
(2) Date: Apr. 18, 2019

(87) PCT Pub. No.: WO2018/077983
PCT Pub. Date: May 3, 2018

(65) Prior Publication Data

US 2019/0314813 A1 Oct. 17, 2019

Related U.S. Application Data

(60) Provisional application No. 62/413,019, filed on Oct. 26, 2016.

(30) Foreign Application Priority Data

Oct. 26, 2016 (EP) ..... 16195853

(51) Int. Cl.
*B01L 3/00* (2006.01)

(52) U.S. Cl.
CPC ... *B01L 3/50273* (2013.01); *B01L 2200/0621* (2013.01); *B01L 2200/16* (2013.01); (Continued)

(58) Field of Classification Search
CPC ..... B01L 3/50273; B01L 2200/0621; B01L 2200/16; B01L 2300/0803; B01L 2400/0409; B01L 2400/0457
See application file for complete search history.

(56) References Cited

U.S. PATENT DOCUMENTS

2010/0074801 A1* 3/2010 Saiki ..... B01L 3/502715 422/68.1
2015/0104814 A1* 4/2015 Kim ..... B01L 3/502738 435/7.23

OTHER PUBLICATIONS

PCT International Search Report for PCT International Patent Application No. PCT/EP2017/077365; dated Apr. 6, 2018; (3 pages).

* cited by examiner

*Primary Examiner* — Jennifer Wecker
*Assistant Examiner* — Oyeleye Alexander Alabi
(74) *Attorney, Agent, or Firm* — K&L Gates LLP

(57) ABSTRACT

The invention provides a microfluidic system comprising a cartridge coupled to a motor and adapted to move a fluid sample to a plurality of locations on the cartridge. The cartridge comprises a chevron shaped or substantially V shaped reaction chamber having at least three zones, a first zone positioned near the apex of the V shaped reaction chamber to define a detection zone, a second zone positioned near a first end of the V shaped reaction chamber and a third zone positioned near a second end of the V shaped reaction chamber. The motor and a control module is configured to provide a combination of centrifugal force and gravitational force to move said fluid sample between at least three zones.

16 Claims, 5 Drawing Sheets

(52) U.S. Cl.
CPC ..... *B01L 2300/0803* (2013.01); *B01L 2400/0409* (2013.01); *B01L 2400/0457* (2013.01)

POINT-OF-CARE DIAGNOSTIC ASSAY CARTRIDGE

CROSS REFERENCE TO RELATED APPLICATIONS

This application is a national phase under 35 U.S.C. § 371 of International Application No. PCT/EP2017/077365 filed Oct. 25, 2017, which claims priority to and benefit of U.S. Provisional Application No. 62/413,019 filed Oct. 26, 2016 and European Patent Application No. 16195853.3 filed Oct. 26, 2016, and the entirety of these applications are incorporated by reference herein.

FIELD

The invention relates to a point-of-care cartridge. In particular the invention relates to a point-of-care diagnostic assay system based on centrifugal microfluidic technology.

BACKGROUND

Manual processing to determine the biochemical content of various types of samples, is cost-prohibitive in many applications and is also prone to errors. Automation is also cost-prohibitive in many applications, and is inappropriate as currently practiced—using, for example, liquid handling robots—for applications such as point-of-care or doctor's office analysis. As a result, there is an unmet is need to provide sample processing for biochemical assays that is less expensive and less prone to error than current automation or manual processing.

Typically it is very difficult to move fluids radially inward using centrifugal microfluidics as the primary means of fluid movement. This can limit/restrict the options available to allow a sequential assay to be performed.

Certain point-of-care diagnostic assay systems based on centrifugal microfluidic technology are quite good at performing the necessary integrated sample preparation and assay measurement steps. Such a centrifugal microfluidic platform with optical detection allows for a variety of assay technologies to be implemented in parallel using a single instrument and disposable cartridges Examples of point-of-care diagnostic assay systems include U.S. Pat. No. 9,182,384B2 (Roche), U.S. Pat. No. 8,415,140B2 (Panasonic), U.S. Pat. No. 8,846,380 (Infopia), U.S. Pat. No. 5,591,643 (Abaxis), U.S. Pat. No. 5,409,665 (Abaxis).

US Patent Publication No. US 2010/074801 describes an analyser comprising a microchip coupled to a motor, where the microchip acquires a liquid sample by means of capillary action. The microchip overcomes the limitation of using capillary action to move a liquid sample by providing a structure which reduces capillary pressure. This is achieved by providing each channel with an adjoining cavity open to atmospheric pressure, which acts so as to prevent an increase in capillary pressure as the fluid length increases. Thus, in one embodiment of the invention, the microchip structure comprises an inlet for collecting a liquid sample, a capillary cavity for holding a predetermined amount of the liquid sample, a single holding chamber having an analytical reagent, a measuring chamber for measuring the mixture of the liquid sample and the reagent, a channel communicating with the holding chamber and the measuring chamber, and a channel connecting the measuring chamber with an atmospheric vent. In use, a liquid sample in the capillary cavity is transferred by centrifugal force into the holding chamber, where it is mixed with the analytical reagent. This mixture is then transferred out of the holding chamber to the inlet of the measuring is chamber by capillary force, from where it is transferred into the measuring chamber itself by rotation of the analyser. At the measuring chamber, the concentration of a component of the liquid sample is measured. Accordingly, it will be understood that in this patent document, the microchip structure is configured such that once the holding chamber has delivered the mixture of the single reagent and the liquid sample to the measuring chamber, the mixture cannot be returned to the holding chamber.

US Patent Publication No. US 2015/104814 discloses a sample analysis apparatus for whole blood separation. It comprises a rotatable microfluidic apparatus which comprises a sample chamber for accommodating a sample, a channel that provides a path through which the sample flows, and a valve for opening the channel, which is coupled to a valve driver and a control unit. A separation chamber receives a sample flowing from the sample chamber due to centrifugal force, while a collection chamber for collecting target cells is connected to the separation chamber. In use, the apparatus is rotated to separate the sample into a plurality of layers in the separation chamber according to density gradients of materials in the sample, such as for example a DGM layer, an RBC layer, a WBC layer and a plasma layer. The target material located in the lowermost portion of the separation chamber along with the DGM is then transported to the collection chamber for recovery.

It is therefore an object to provide an improved point-of-care diagnostic assay systems based on centrifugal microfluidic technology.

SUMMARY

According to the invention, there is provided, as set out in the appended claims, a microfluidic system comprising:

- a cartridge coupled to a motor and adapted to move a fluid sample to a plurality of locations on the cartridge, wherein the cartridge is configured to rotate on an inclined plane with respect to a horizontal plane;
- the cartridge comprises a chevron shaped or substantially V shaped reaction chamber having at least three zones, wherein a first zone is is positioned near the apex of the V shaped reaction chamber to define a detection zone, a second zone positioned near a first end of the V shaped reaction chamber and a third zone positioned near a second end of the V shaped reaction chamber, wherein each of the second zone and the third zone comprise a reagent zone; and
- the motor and a control module is configured to provide a combination of centrifugal force and gravitational force to move said fluid sample between the at least three zones.

It will be appreciated the cartridge of the invention provides a number of advantages over the prior art:

- Overall cartridge concept uses gravitational and centrifugal microfluidic methods
- Single volume reaction, i.e. removes the need for any or all of the steps including: dilution, aliquoting or metering of reagents which simplifies operation and potentially improves test precision
- Sequential optical measurements in a single cuvette for each assay phase to improve precision
- Location of R1 and R2 reagents for sequential rehydration
- Homogenous mixing of sample and buffer
- Ability to carry out an optical measurement on buffer and/or sample Cuvette filling using centrifugal force to provide an even liquid meniscus for consistent optical interrogation Optical measurement of the assay reaction using static or dynamic (while rotating) methods In one embodiment the first detection zone comprises a cuvette and positioned at the radial extent of the V shaped reaction chamber.

In one embodiment the V shaped chamber extends radially inward on two sides to create two zones that can be independently filled with fluid to define the second zone and third zone.

In one embodiment the second and/or third zone comprises a reagent storage and/or rehydration zones.

In one embodiment the second and/or third zone comprises a region adapted to be optically interrogated.

In one embodiment the cartridge is positioned and configured to rotate at a velocity such that a combination of centrifugal force and gravity moves the fluid sample radially outward and inward respectively.

In one embodiment the cartridge rotates at a velocity such that the relative centrifugal force (RCF) is greater than gravity, and the fluid sample can be moved radially outward on the cartridge.

In one embodiment the centrifugal force ensures that no fluid reaches the second zone or third zone.

In one embodiment the cartridge is stationary or rotating slowly, gravity will influence the fluid and move the fluid towards the second zone or third zone.

In one embodiment the cartridge is rotated or agitated on an inclined plane with respect to a horizontal plane to create a downward slope for the fluid sample to flow under the influence of gravity.

In one embodiment, the cartridge is further configurable to be agitated to overcome any effects of surface tension that may prevent the fluid from flowing under the influence of gravity.

In one embodiment the cartridge rotates on an inclined plane at an angle of $\theta i$ from the horizontal plane and wherein the angle is between 10° to 60°.

In one embodiment a buffer reservoir is positioned close to the centre of rotation of the cartridge and a module configured for applying a sample directly to the cartridge.

In one embodiment the dominant force on the fluid sample meniscus is the centrifugal force such that the centrifugal force is parallel to the upper and lower surface of the first detection zone to provide a meniscus evenly on both surfaces.

In one embodiment the second zone comprises a dried reagent.

In one embodiment the third zone comprises a dried reagent.

In one embodiment the dried reagent remains intact until the second or third zones are rehydrated with the fluid sample and a buffer solution.

In one embodiment the dried reagent can be spotted in singular or multiple spots in said second and/or third zones.

In one embodiment the second or third zone comprises multiple dried reagents.

In one embodiment the cuvette comprises a single volume cuvette configured to allow for optical measurement of the buffer solution, the fluid sample and the rehydrated reagents used in each phase of an assay.

In one embodiment the system is configured for performing an immunoturbidimetric or an enzyme-based clinical chemistry assay.

In another embodiment there is provided, a microfluidic system comprising:

a cartridge coupled to a motor and adapted to move a fluid sample to a plurality of locations on the cartridge;

the cartridge comprises a chevron shaped or substantially V shaped reaction chamber having at least three zones, wherein a first zone is positioned near the apex of the V shaped reaction chamber to define a detection zone, a second zone positioned near a first end of the V shaped reaction chamber and a third zone positioned near a second end of the V shaped reaction chamber; and the motor and a control module is configured to provide a combination of is centrifugal force and gravitational force to move said fluid sample between the at least three zones.

BRIEF DESCRIPTION OF THE DRAWINGS

The invention will be more clearly understood from the following description of an embodiment thereof, given by way of example only, with reference to the accompanying drawings, in which.

DETAILED DESCRIPTION OF THE DRAWINGS

Figure 1:
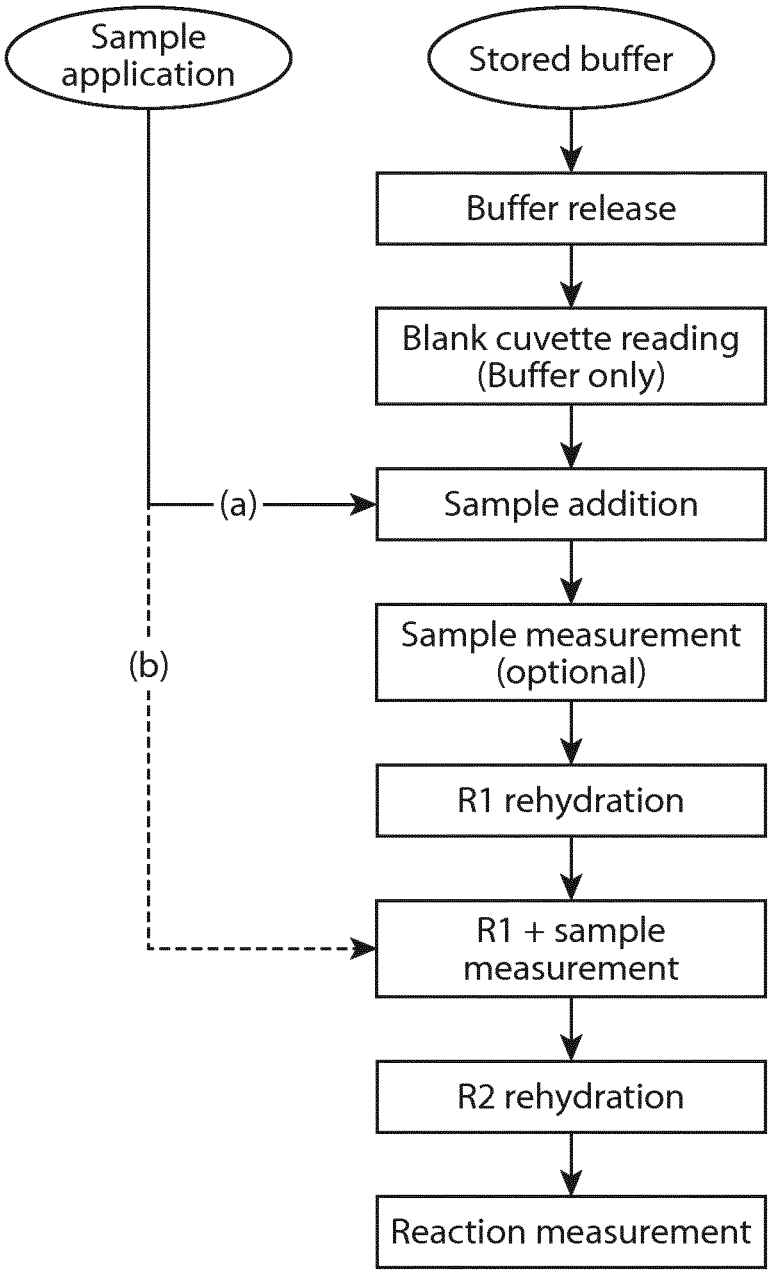
FIG. 1 is a flow chart illustrating a number of sequential steps required to transfer a 2-step dried reagent assay onto a self-contained/single-use/disposable point-of-care (POC) cartridge.

FIG. 1 illustrates a number of sequential steps required to transfer a 2-step dried reagent assay onto a self-contained/single-use/disposable point-of-care (POC) cartridge. This sequence can be applied to immunoturbidimetric and enzyme-based clinical chemistry assays that require two-step addition & rehydration of reagents R1 and R2 to complete a test measurement. A similar test sequence can be used for a 1 step assay where reagents R1 or R2 are used only.

The POC cartridge can include a buffer reservoir and will have a means to apply a sample (for example whole blood, plasma, serum) to the cartridge. The cartridge may contain dried, immobilised reagents (R1 and R2) stored in specific locations on the cartridge that can be rehydrated independently. Depending on where the sample is added in the sequence (option (a) or (b) in FIG. 1), R1 can be rehydrated by either diluted sample (buffer+sample) or buffer only. R2 is then rehydrated by this same fluid volume.

Figure 2:
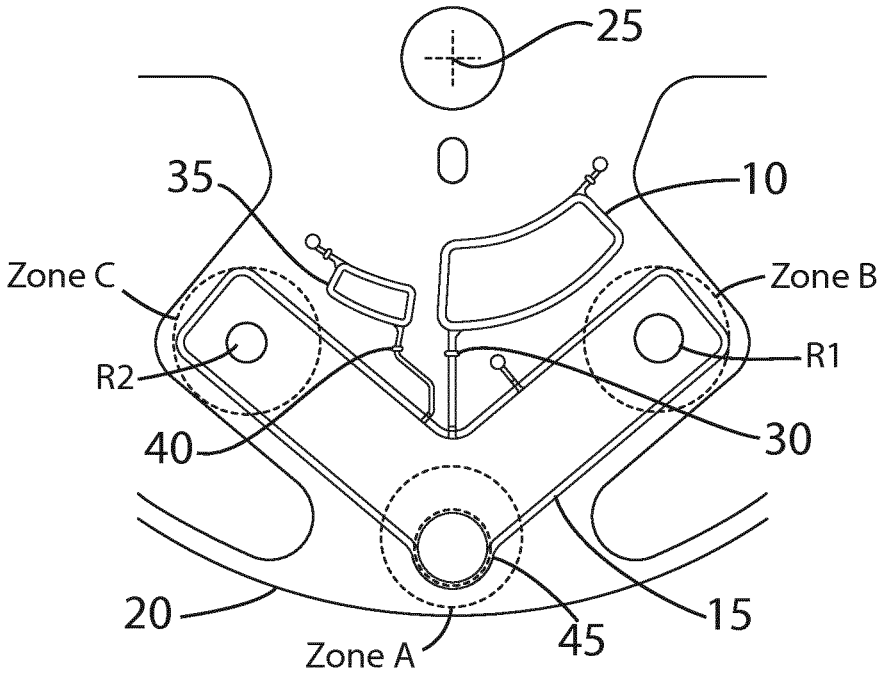
FIG. 2 shows a cartridge design embodiment to perform the assay sequence according to a first embodiment of the invention.

FIG. 2 shows a cartridge design embodiment to perform the assay sequence illustrated in the flow chart of FIG. 1, according to a first embodiment of the invention. The cartridge design employs a combination of centrifugal and gravitational microfluidics to move fluids to multiple locations on the cartridge. The cartridge 5 includes a buffer reservoir 10 that will sit at or close to the centre of rotation 25. There is also provided a means for applying a sample directly to the cartridge (not shown in FIG. 2). The cartridge, layout described in more detail below, resolves the following problems:

- Single volume reaction, i.e. removes the need for any or all of the steps including: dilution, aliquoting or metering of reagents which simplifies operation and potentially improves test precision
- Sequential optical measurements in a single cuvette for each assay phase to improve precision
- Location of R1 and R2 reagents in distinct zones for sequential rehydration
- Homogenous mixing of sample and buffer and the ability to carry out an optical measurement on buffer and/or sample Referring to FIG. 2 the cartridge 5 comprises a chevron shaped or substantially V shaped reaction chamber 15 having at least three zones. A first zone is positioned near the apex of the V shaped reaction chamber to define a detection zone. A second zone is positioned near a first end of the V shaped is reaction chamber and a third zone is positioned near a second end of the V shaped reaction chamber. The motor and a control module is configured to provide a combination of centrifugal force and gravitational force to move said fluid sample between the three zones.

In operation, centrifugal force is used to control the delivery of a stored buffer from its reservoir 10 and/or subsequent buffer chambers prior to being delivered to the reaction chamber 15. The reaction chamber 15 is sized such that it is much greater than the buffer reaction volume that will be used. The reaction chamber 15 incorporates three distinct zones: A) cuvette detection zone, B) R1 reagent zone and C) R2 reagent zone. The cuvette 45 is located at the radial extent of the reaction chamber 15 (typically close to the cartridge outer diameter 20). The chamber extends radially inward on two sides to create two zones that can be independently filled with fluid for the R1 and R2 reactions. It is beneficial that each zone is sized such that when occupied by buffer they can hold the entire volume within the zone, i.e. the volume of zone A, B or C is equal or greater than the buffer volume and the entire reaction chamber 15 is at a minimum of 3× greater than the buffer volume.

Typically it is very difficult to move fluids radially inward using centrifugal microfluidics as the primary means of fluid movement. This can limit/restrict the options available to allow a sequential assay to be performed. To overcome this problem, a combination of centrifugal force and gravity are used to move fluids radially outward and inward respectively. When the cartridge 5 rotates at velocities where the relative centrifugal force (RCF) is much greater than gravity, centrifugal forces will dominate and fluid can be moved radially outward on the cartridge. When the cartridge 5 is stationary or rotating slowly, gravity will still influence the fluid and can be used to move the fluid. To take advantage of this, the cartridge 5 is rotated on an inclined plane (from the horizontal) such that the cartridge 5 can be positioned statically to create a downward slope for fluid to flow. This method can be employed to move fluids radially inward on the cartridge when it is aligned in particular orientations. The flow of fluid under gravity can also be aided by gentle agitation/shaking to overcome any effects of is surface tension that may prevent fluids from flowing.

In FIG. 2, the buffer stored centrally in the buffer chamber is delivered to the reaction chamber 15 (via a capillary valve 30) by centrifugal force. This buffer volume fills the cuvette 45 (Zone A) and a blank measurement of buffer can be performed. Next, the applied sample in the sample chamber 35 is also delivered by centrifugal force (via a capillary valve 40) into the reaction chamber 15 (Zone A) where it is mixed with the buffer. It is appreciated that the sample chamber may include additional sample processing steps such as but not limited to plasma separation or whole blood lysis. A sample measurement can be taken at this point in the test sequence if required (may be used as an internal control). During both buffer and sample delivery steps, the centrifugal force ensures that no fluid reaches Zones B or C and the dried reagents remain intact until R1 and R2 are to be rehydrated.

The cartridge 5 is then aligned to allow the fluid within Zone A to flow to Zone B under gravity (aided by gentle agitation if required). The sample and buffer suspension wets reagent R1 and begins rehydrating it. The rehydration continues for a defined period of time until full rehydration has been achieved.

Figure 3:
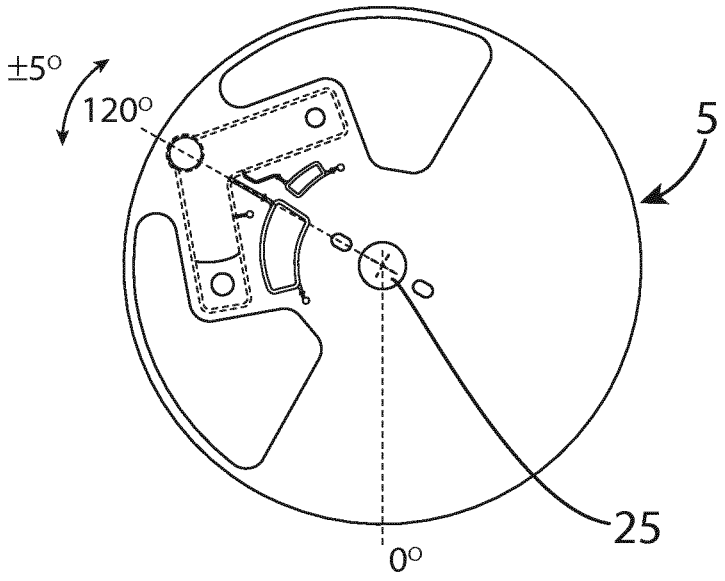
FIG. 3 illustrates a normal view of the cartridge surface showing reagent rehydration.

This rehydration can be aided by mixing/agitation. When fully rehydrated, centrifugal force is used to move the sample, buffer and R1 suspension back to the cuvette 45 (Zone A) where a calibration measurement can be performed on this suspension. FIG. 3 illustrates a normal view of the cartridge surface showing reagent rehydration.

Similar to the rehydration of reagent R1, the cartridge 5 is then orientated to allow the fluid to flow from the cuvette 45 to Zone C where the R2 reagent(s) are wetted by the buffer, sample and R1 suspension. Again, rehydration continues for a defined period of time until both dried reagents are fully rehydrated. The rehydration can again be aided by mixing agitation on the cartridge 5. Finally, the entire fluid volume is returned to the cuvette 45 (Zone A) where the final reaction can be monitored. It is worth noting that reagents R1 and/or R2 can be spotted in singular or multiple spots.

Figure 4:
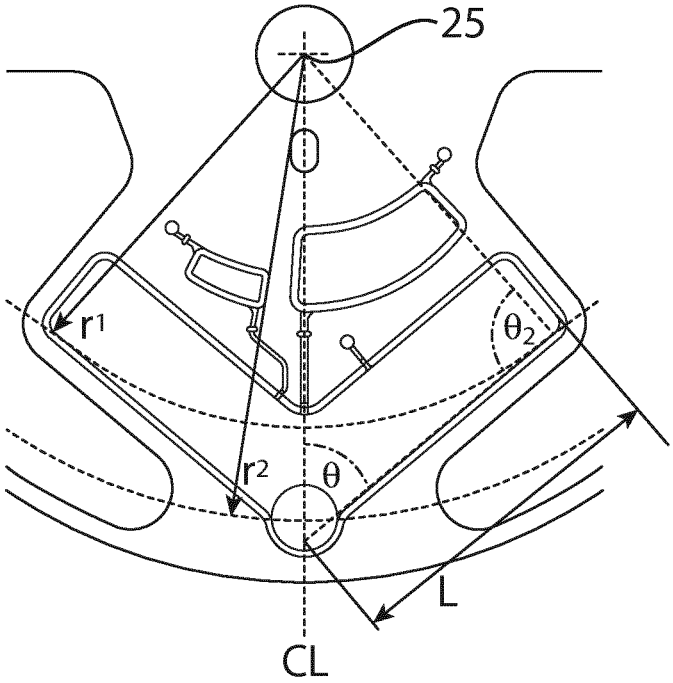
FIG. 4 illustrates a chevron shaped or substantially V shaped reaction chamber having at least three zones, according to one embodiment.

Illustrated in FIG. 4 are the radii r1 and r2, the angles θ and θ2 and the length L. The reagent spot locations are not shown for simplicity. r1 is the radius at which the distal wall of the reaction chamber in Zone B and Zone C is located while r2 is the radius at which the cuvette is centered in Zone A. The length L is the length of distal wall of the reaction chamber. θ is the angle at which the wall is defined from the centerline (created through the center of rotation 25 and the center of the cuvette) and θ2 is the angle formed between a notional centerline (through the center of rotation) and the distal wall of the reaction chamber at the extent of the chamber. In this embodiment, the reaction chamber is designed symmetrically about the centerline which can be advantageous but is not a requirement and can be designed asymmetrically. It is preferred that the length of the chamber wall (L) does not extend beyond a point such that the angle θ2 is <90°. When the angle θ2 remains 90°, this ensures that the radius r1<r2. Under centrifugal force, this allows fluid to return to the cuvette region at r2 since fluid will tend towards the outer radius.

Figure 5:
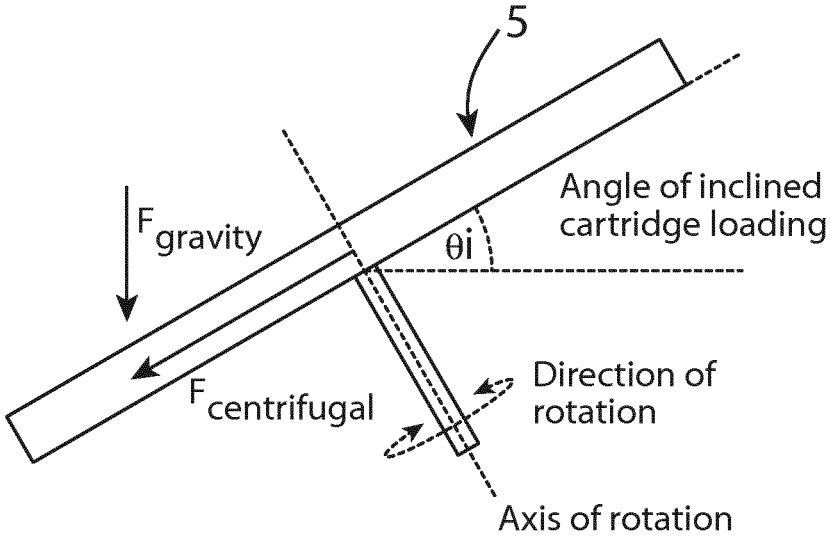
FIG. 5 shows a side view of the cartridge mounted on a motor platform during operation.

FIG. 5 shows a side view of the cartridge 5 mounted during operation. The cartridge rotates on an inclined plane at an angle of θi (from horizontal). It is ideal that the inclined angle is between 10° to 60°, preferably 30° (provides sufficient gravity and is beneficial for ease of use). Also highlighted are the directions of the centrifugal force and gravity force. The centrifugal force will always be perpendicular to the axis of rotation, i.e. acts in the radial direction (outward) upon rotation.

For example FIG. 3 shows the cartridge rotated to align at an angle of 120° from a zero position. In one embodiment the zero position can be the lowest point of the cartridge plane with respect to the center of rotation to enable operation. In this location, Zone B can be filled with fluid from Zone A since the cartridge is secured on an inclined plane. After reagent rehydration is performed in Zone B, the fluid can be returned to Zone A (cuvette) for detection by centrifugal or gravity driven methods. However, it is highly preferred that centrifugal force is used to achieve consistent filling of the cuvette.

Figure 6:
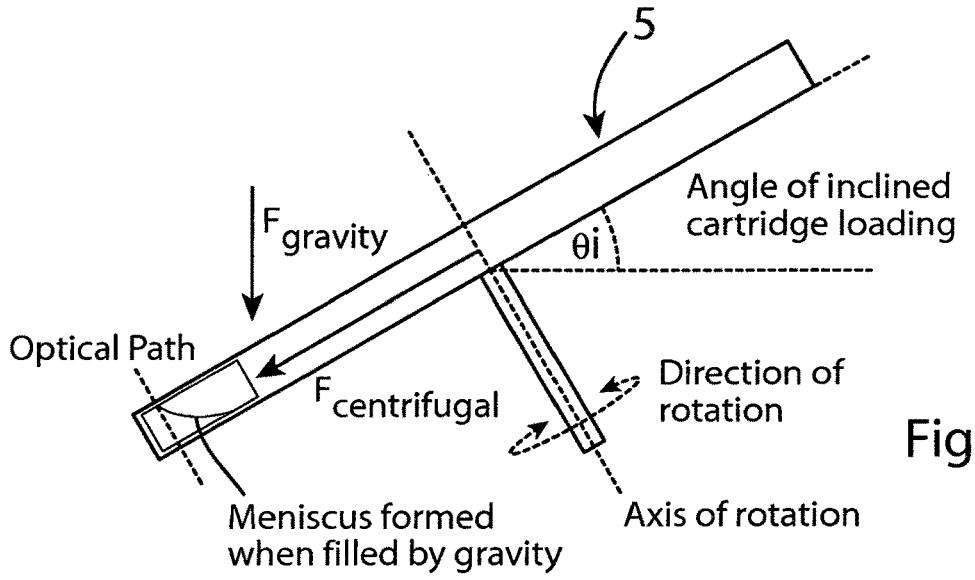
FIG. 6, FIG. 7 and FIG. 8 illustrate the benefit of filling the cuvette by centrifugal force.
Figure 7:
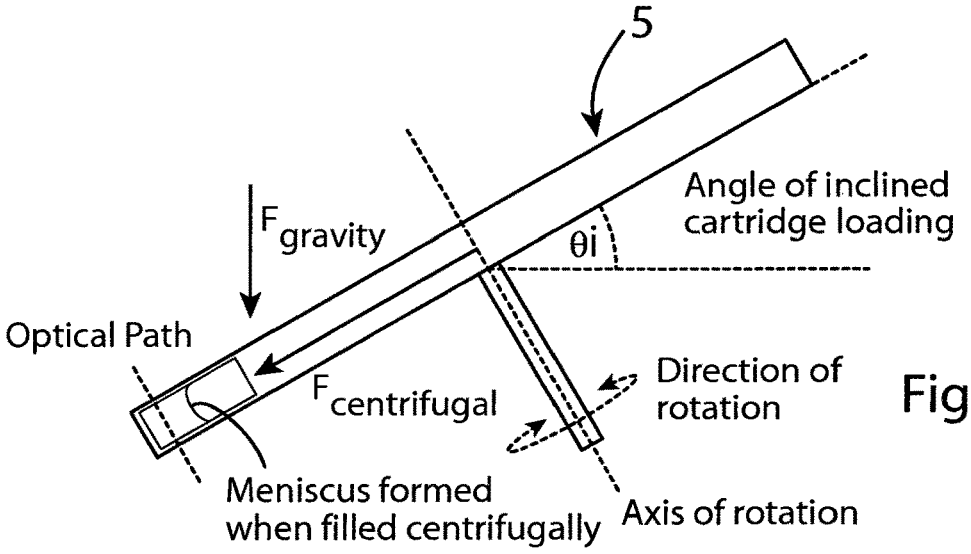
Figure 8:
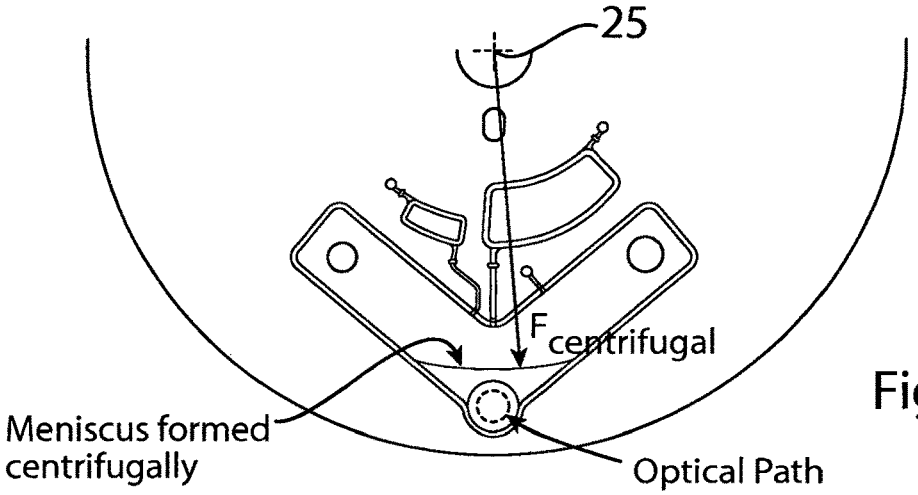

FIG. 6, FIG. 7 and FIG. 8 illustrate the benefit of filling the cuvette by centrifugal force as opposed to gravity. The optical detection path is normal to the cartridge surface and so is aligned perpendicular to the angle at which the cartridge 5 is inclined. It is important that the cuvette is filled entirely and consistently by a column of fluid to ensure that there are no optical irregularities arising from partially or badly filled cuvettes. If the cuvette is filled by gravity, the dominant force on the liquid meniscus is gravity and so the meniscus shape will be uneven and is likely to wet the upper and lower cuvette surfaces to varying levels (FIG. 6). However, when filled by centrifugal force (FIG. 7), the dominant force on the liquid meniscus is the centrifugal force. Since the centrifugal force is parallel to the upper and lower surface of the cuvette, the meniscus is formed evenly on both surfaces. This ensures that the detection zone will always be sufficiently filled with fluid during optical measurements. FIG. 8 shows the formed meniscus when viewing the cartridge normal to the axis of rotation. The optical path (which may be larger or smaller than shown) can be filled entirely by centrifugal force. Additionally, filling by centrifugal force also ensures that the cuvette is entirely free from air by preventing any trapped air bubbles forming within the optical window.

Figure 9:
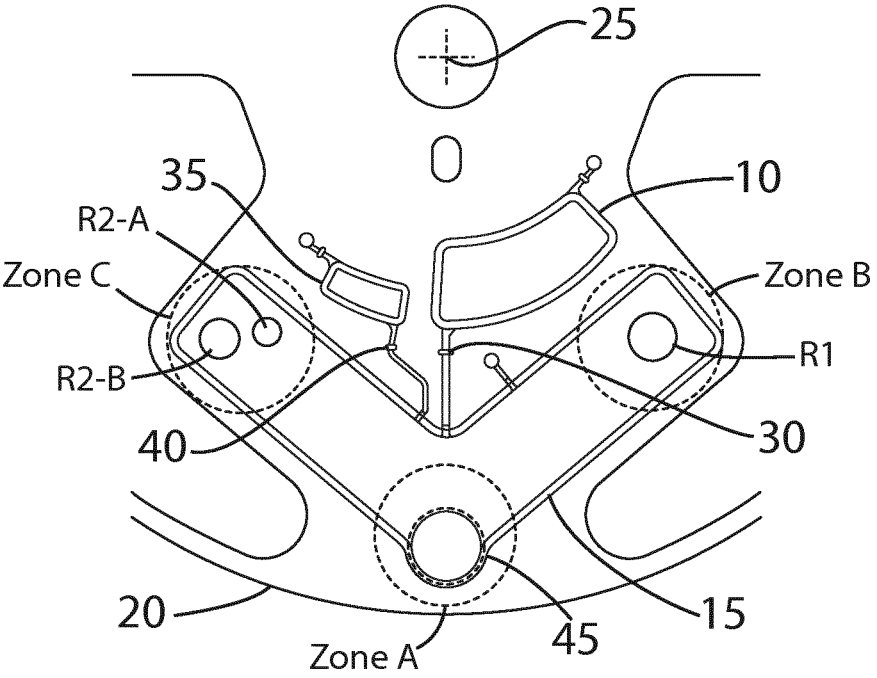
FIG. 9 shows a cartridge design embodiment to perform the assay sequence according to an embodiment of the invention which uses a second dried reagent spot in the third reagent zone.

FIG. 9 shows a cartridge design embodiment to perform the assay sequence according to an embodiment of the invention which uses a second dried reagent spot in the third reagent zone. In FIG. 9, the buffer stored centrally in the buffer chamber 10 is delivered to the reaction chamber 15 (via a capillary valve 30) by centrifugal force. This buffer volume fills the cuvette 45 (Zone A) and a blank measurement of buffer can be performed. Next, the applied sample in the sample chamber 35 is also delivered by centrifugal force (via a capillary valve 40) into the reaction chamber 15 (Zone A) where it is mixed with the buffer. A sample measurement can be taken at this point in the test sequence if required (may be used as an internal control). During both buffer and sample delivery steps, the centrifugal force ensures that no fluid reaches Zones B or C and the dried reagents remain intact until R1 and R2 are to be rehydrated.

The cartridge is then aligned to allow the fluid within Zone A to flow to Zone B under gravity (aided by gentle agitation if required). The sample and buffer suspension wets reagent R1 and begins rehydrating it. The rehydration continues for a defined period of time until full rehydration has been achieved. This rehydration can be aided by mixing/agitation. When fully rehydrated, centrifugal force is used to move the sample, buffer and R1 suspension back to the cuvette 45 (Zone A) where a calibration measurement can be performed on this suspension.

Similar to the rehydration of reagent R1, the cartridge is then orientated to allow the fluid to flow from the cuvette 45 to Zone C where the R2 reagents (split in to reagents R2-A and R2-B) are wetted by the buffer, sample and R1 suspension. Again, rehydration continues for a defined period of time until both dried reagents are fully rehydrated. The rehydration can again be aided by mixing agitation on the cartridge. Finally, the entire fluid volume is returned to the cuvette 45 (Zone A) where the final reaction can be monitored. Reagents R1 and/or R2 can be spotted in singular or multiple spots It will be appreciated from the above description that microfluidic system of the present invention is suitable for performing any type of immunoturbidimetric and enzyme-based clinical chemistry assay. Furthermore, the microfluidic system of the present invention is very flexible, as it can be used to perform an assay that requires the addition and rehydration of a single reagent, as well as to perform an assay that requires the addition and rehydration of multiple reagents. This is due to the fact that the second and/or third reagent zones of the cartridge can each be provided with multiple reagent spots.

In the specification the terms "comprise, comprises, comprised and comprising" or any variation thereof and the terms include, includes, included and including" or any variation thereof are considered to be totally interchangeable and they should all be afforded the widest possible interpretation and vice versa.

The invention is not limited to the embodiments hereinbefore described but may be varied in both construction and detail.

The invention claimed is:

1. A microfluidic system for performing an assay comprising a plurality of phases comprising:

a cartridge comprising:

a chevron shaped or substantially V shaped reaction chamber having at least three zones, a first zone positioned near the apex of the V shaped reaction chamber being a detection zone comprising a cuvette for single or sequential optical measurements of each phase of the assay, a second zone positioned near a first end of the V shaped reaction chamber and a third zone positioned near a second end of the V shaped reaction chamber, an axis of rotation oriented at a predetermined angle relative to the horizontal plane, and a motor and a control module configured to rotate the cartridge around the axis of rotation and further configured to control at least the angular position of the cartridge about the axis of rotation, wherein a fluid sample is selectively driven in response to the rotation of the cartridge between one or more zones of the cartridge in a predetermined sequence using gravitational force, centrifugal force, or both simultaneously.

2. The microfluidic system as claimed in claim 1 wherein the cartridge is disc shaped and wherein the cuvette is positioned adjacent to the outer diameter of the cartridge.

3. The microfluidic system as claimed in claim 1 wherein the V shaped chamber extends radially inward from the first zone on two sides to create two zones that can be independently filled with fluid to define the second zone and third zone.

4. The microfluidic system as claimed in claim 1 wherein the cartridge is configured to rotate on the inclined plane at a velocity such that a combination of centrifugal force and gravity influence the movement of the fluid sample radially outward and inward respectively in operation.

5. The microfluidic system as claimed in claim 1 wherein the cartridge is configured to rotate at a velocity such that the relative centrifugal force (RCF) is greater than gravity, and the fluid sample can be moved radially outward on the cartridge.

6. The microfluidic system as claimed in claim 1 wherein the cartridge is configured such that no fluid reaches the second zone or third zone when the fluid sample is under the influence of the centrifugal force.

7. The microfluidic system as claimed in claim 1 wherein when the cartridge is configured to be stationary or configured to rotate slowly, gravity will influence the fluid and move the fluid towards the second zone or third zone.

8. The microfluidic system as claimed in claim 7 wherein the cartridge is further configurable to be agitated to overcome any effects of surface tension that may prevent the fluid from flowing under the influence of gravity.

9. The microfluidic system as claimed in claim 1 wherein the second zone comprises a dried reagent.

10. The microfluidic system as claimed in claim 1 wherein the third zone comprises a dried reagent.

11. The microfluidic system as claimed in claim 9 wherein the cartridge is configured such that the dried reagent remains intact until the second or third zones are rehydrated with the fluid sample and a buffer solution.

12. The microfluidic system as claimed in claim 9 wherein the dried reagent can be spotted in singular or multiple spots in said second and/or third zones.

13. The microfluidic system as claimed claim 9 wherein the second or third zone comprises multiple dried reagents.

14. The microfluidic system as claimed in claim 11, wherein the cuvette comprises a single volume cuvette configured to allow for optical measurement of the buffer solution, the fluid sample and the rehydrated reagents used in each phase of the assay.

15. The microfluidic system as claimed in claim 1, wherein the cartridge is configured for performing an immunoturbidimetric or an enzyme-based clinical chemistry assay.

16. The microfluidic system of claim 1, wherein a fluid sample is selectively driven to each of the at least three zones of the cartridge in a predetermined sequence.

* * * * *